US008152701B2

(12) United States Patent
Shen

(10) Patent No.: US 8,152,701 B2
(45) Date of Patent: Apr. 10, 2012

(54) COUNTERWEIGHT MODULE STRUCTURE OF A WEIGHT TRAINER

(75) Inventor: Jyun-Wei Shen, Dounan Township, Yunlin County (TW)

(73) Assignee: Ze-Jing Hang, Dounan Township, Yunlin County (TW)

( * ) Notice: Subject to any disclaimer, the term of this patent is extended or adjusted under 35 U.S.C. 154(b) by 0 days.

(21) Appl. No.: 12/953,629

(22) Filed: Nov. 24, 2010

(65) Prior Publication Data

US 2011/0195824 A1 Aug. 11, 2011

(30) Foreign Application Priority Data

Feb. 5, 2010 (TW) ..... 99202370 U

(51) Int. Cl.
*A63B 21/00* (2006.01)

(52) U.S. Cl. ..... 482/98; 482/99

(58) Field of Classification Search ..... 482/98, 482/99, 102, 104
See application file for complete search history.

(56) References Cited

U.S. PATENT DOCUMENTS

| | | | | |
|---|---|---|---|---|
| 5,328,428 | A * | 7/1994 | Huang | 482/98 |
| 6,497,639 | B2 * | 12/2002 | Webber et al. | 482/98 |
| 6,558,300 | B2 * | 5/2003 | Deola | 482/99 |
| 7,473,211 | B2 * | 1/2009 | Lee | 482/97 |
| 7,938,762 | B2 * | 5/2011 | Nishimura | 482/111 |

* cited by examiner

*Primary Examiner* — Jerome W Donnelly
(74) *Attorney, Agent, or Firm* — Egbert Law Offices PLLC

(57) ABSTRACT

An improved counterweight module of a weight trainer having two vertical guide rods as well as top, bottom and intermediate counterweight blocks superimposed along the vertical guide rods. It is mainly characterized in that a liner ring assembly is only assembled onto the bottom and top counterweight blocks. The liner ring assembly has upper liner rings set into the top counterweight block and lower liner rings set into the bottom counterweight block. The annular rings of the upper and lower liner ring are mated slidably with two vertical guide rods. Moreover, a guide rod pulling portion is set onto every intermediate counterweight block for penetration of the vertical guide rod. There is a spacing between the guide rod pulling portion and vertical guide rods. The superimposition surface of the counterweight block is provided with a mating portion to enable limitation of every intermediate counterweight block.

9 Claims, 7 Drawing Sheets

COUNTERWEIGHT MODULE STRUCTURE OF A WEIGHT TRAINER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a weight trainer's unit construction, and more particularly to an innovative one which is configured with a counterweight module.

2. Description of Related Art Including Information Disclosed Under 37 CFR 1.97 and 37 CFR 1.98.

The weight trainer, an important piece of fitness equipment, is structurally designed in such a way to bear load and adjust the balance weight, enabling the users to exercise their muscles on arms and legs, etc.

The structural configuration of counterweight module is crucial to the weight trainer, since the convenience of its weight adjustment and stability of movement are closely related to the applicability and quality of the weight trainer. Hence, continuous efforts are made in this industry to develop more applicable models.

Generally, the counterweight module of the weight trainer is constructed in such a manner that the training weight is increased by means of serial stacking. Yet, it is found in actual applications that, the weight of the counterweight blocks can be adjusted by stacking from bottom to top, or removing from top to bottom, leading to time-consuming and inefficient selection and change of weight. For this reason, a counterweight module disclosed in FIG. 1 has been developed, i.e. several counterweight blocks 10 of equivalent width are superimposed along two vertical guide rods 11. Vertical through-holes 12 are set correspondingly at the middle of the counterweight blocks 10 for penetration of a lifting column 13. A pivoted locating hole 14 is set on the lifting column 13 correspondingly to the counterweight block 10 for selective bolting of pin 15, allowing to quickly switch the intended counterweight blocks 10. Moreover, two sleeving holes 16 are arranged at interval onto every counterweight block 10 for sleeving onto two vertical guide rods 11. As the counterweight block 10 is made of rough cast iron, filled sand or covered iron material under plastic surface, a colloid liner ring 17 is assembled into the sleeving hole 16 of every counterweight block 10, permitting to sleeve out of vertical guide rod 11 at a micro-clearance, realizing smooth sliding between the counterweight block 10 and the vertical guide rod 11. Besides, the vertical through-holes at middle of the top counterweight block are mated with the lifting column by means of welding and tight fit. However, the following shortcomings are still found despite of the existing advantages of the prior art:

As the colloid liner ring 17 assembled into the sleeving hole 16 of every counterweight block 10 is sleeved out of the vertical guide rod 11 at a micro-clearance, the friction factor at a cylindrical contact area will be generated between the colloid liner ring 17 of every counterweight block 10 and the vertical guide rod 11. With the increasing number of the counterweight blocks 10, the frictional resistance will grow with the lifting action, leading to loss of the accuracy of weight adjustment. This is because the friction factor between the colloid liner ring 17 of the counterweight block and the vertical guide rod 11 will generate a damping phenomenon during lifting motion of the counterweight blocks 10. In such cases, the actual load borne by the users is much bigger than the weight of the counterweight blocks 10. When the force applied by the user is released, the falling resilience of the counterweight blocks 10 will become stagnant due to the friction factor, leading to loss of the accuracy.

BRIEF SUMMARY OF THE INVENTION

The enhanced efficacy of the present invention is as follows:

Based on the unique configuration of the present invention, the friction between the counterweight block of the counterweight module and the vertical guide rod can be minimized, while the lifting friction will not increase with growing number of counterweight blocks. In such case, the influence of the actuating resistance of the counterweight blocks can be minimized, so as to ensure the weight accuracy of the weight trainer and improve greatly its applicability and industrial efficacies.

The improvements brought about by this invention are as follow:

Based on the configuration wherein the guide rod pulling portion of the intermediate counterweight block is designed with a lateral recessing flange, when the top counterweight block and lifting actuating column are lifted into a disengagement state, the intermediate counterweight blocks enable to remove or add weights by vertically swinging to change the angle, thus improving substantially the efficiency and convenience of weight adjustment of the intermediate counterweight blocks.

Based on the configuration wherein the lifting actuating column of the lifting actuator can be mated with the actuating column through-hole of the top counterweight block through an orienting surface, this enables oriented non-offset of the lifting actuating column for more stable elevation.

Based on the configuration wherein a handle is set at top of the lifting actuating column of the lifting actuator, the user is allowed to hold manually the lifting actuating column along with the top counterweight block, so as to remove or add the intermediate counterweight blocks easily.

DETAILED DESCRIPTION OF THE INVENTION

Figure 1:
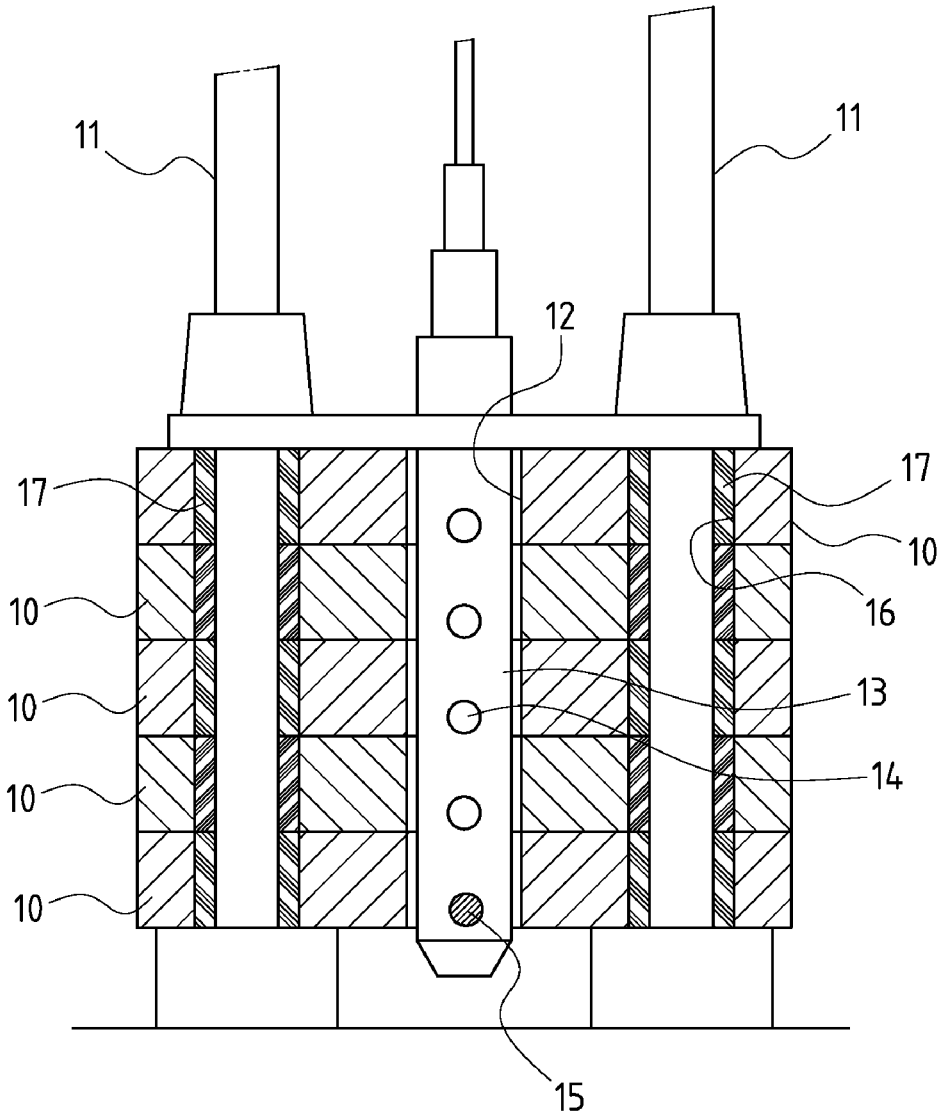
FIG.1 PRIOR ART
FIG. 1 is an assembled sectional view of a typical prior art structure.
Figure 2:
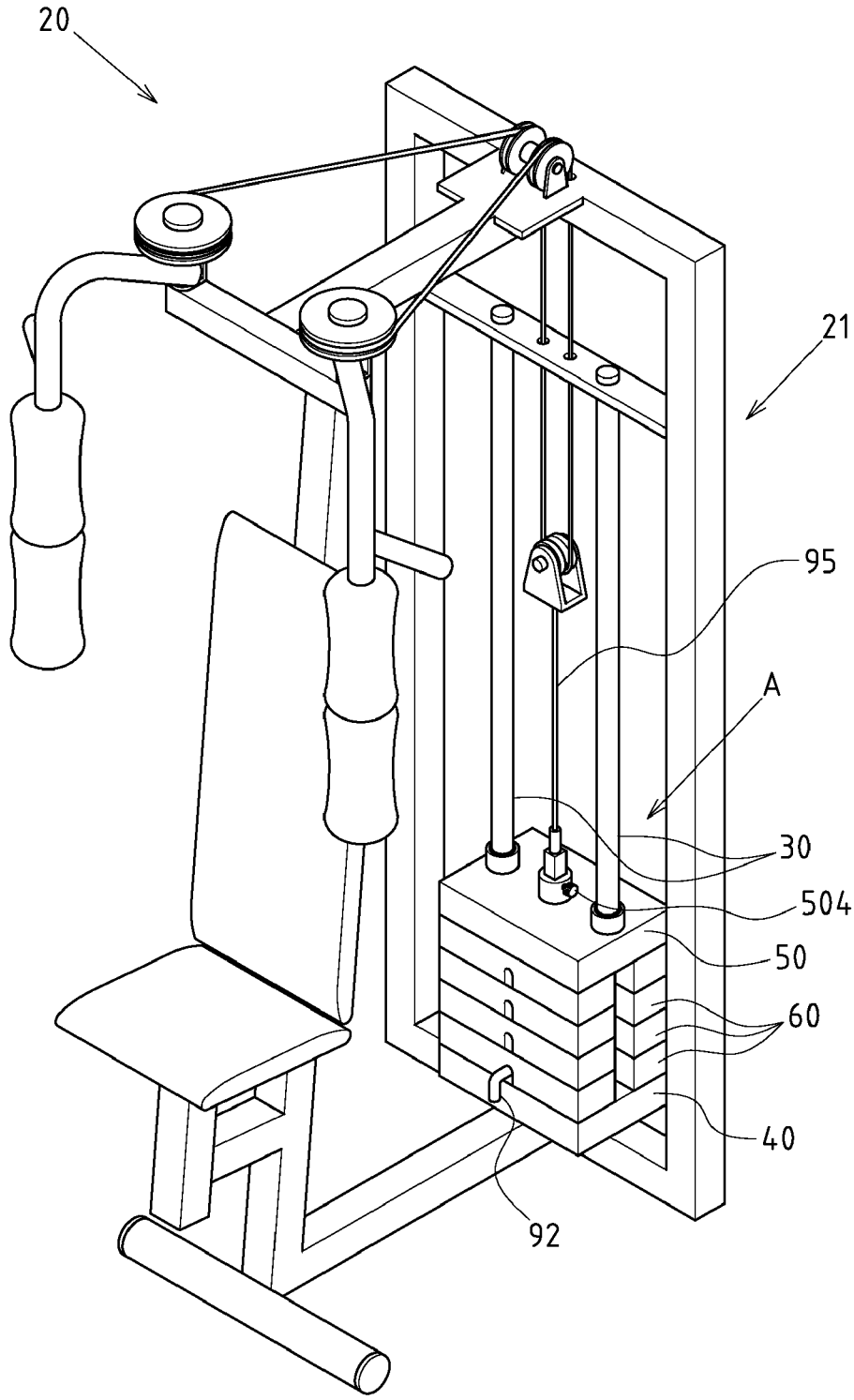
FIG. 2 is a perspective view wherein the counterweight module of the present invention is assembled onto the weight trainer.
Figure 3:
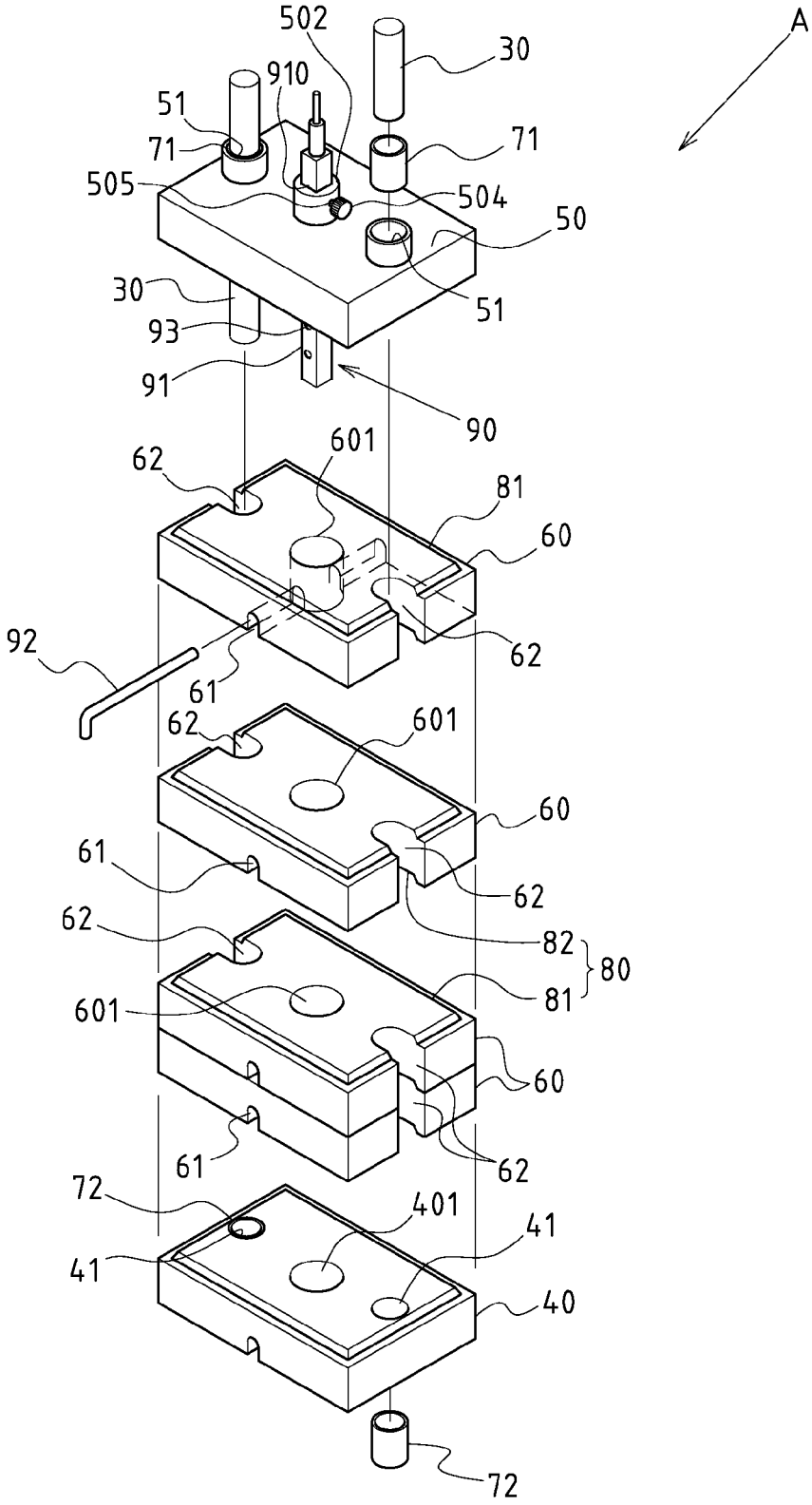
FIG. 3 is an exploded perspective view of the counterweight module of the present invention.
Figure 4:
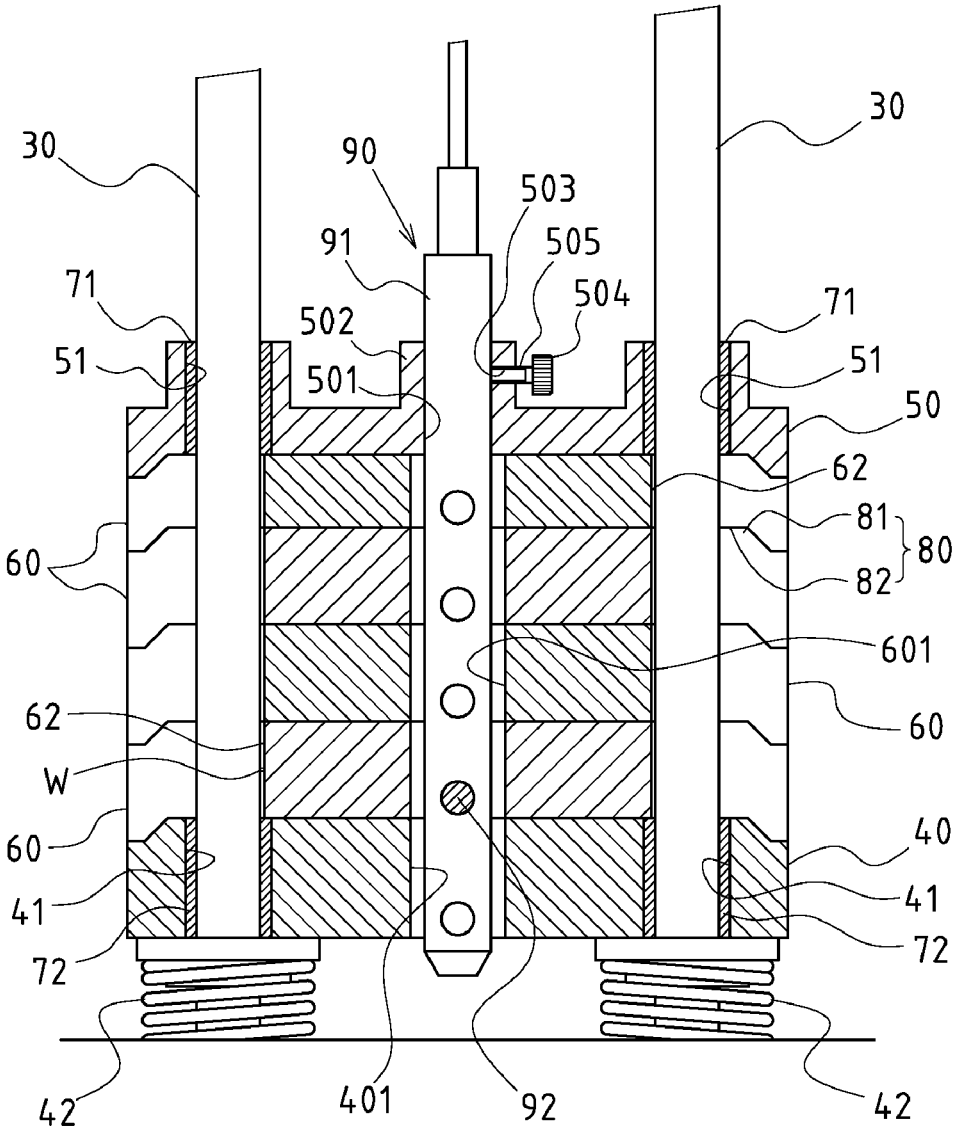
FIG. 4 is an assembled sectional view of the counterweight module of the present invention.

Referring to FIGS. 2, 3 and 4, the counterweight module A is assembled at a preset load 21 of a weight trainer 20, and used to provide the counterweight and adjust the weight required for weight training. The counterweight module A includes two vertical guide rods 30 arranged vertically by spaced parallel.

A bottom counterweight block 40 is assembled transversely at lower part of two vertical guide rods 30. The bottom counterweight block 40 is provided with two spaced sleeving holes 41 for sleeving into two vertical guide rods 30.

A top counterweight block 50 is assembled transversely onto two vertical guide rods 30 overhead the bottom counterweight block 40. The top counterweight block 50 is provided with two spaced punch holes 51 for sleeving into two vertical guide rods 30.

At least one intermediate counterweight block 60 is superimposed transversely between the bottom counterweight block 40 and the top counterweight block 50. A pin threading portion 61 is set laterally onto every intermediate counterweight block 60.

A liner ring assembly is only assembled onto the bottom counterweight block 40 and top counterweight block 50. The liner ring assembly has upper liner rings 71 set into two punch holes 51 of the top counterweight block 50, and lower liner rings 72 set into two sleeving holes 41 of the bottom counterweight block 40. The annular rings of upper and lower liner rings 71, 72 are mated slidably with two vertical guide rods 30. In addition, the annular rings of upper and lower liner rings 71, 72 can be anyone of the glial ring body (such as PP, Teflon, etc.), linear ball bearing, or self-lubricated bearing.

A guide rod pulling portion 62 is set vertically onto every intermediate counterweight block 60 for penetration of the vertical guide rod 30. There is a spacing (marked by W in FIG. 4) between the guide rod pulling portion 62 and vertical guide rod 30.

A mating portion 80 is arranged between the bottom counterweight block 40 and intermediate counterweight block 60, or between the intermediate counterweight blocks 60, or between the intermediate counterweight block 60 and top counterweight block 50, so that the intermediate counterweight blocks 60 can be limited to avoid transverse displacement during lifting motion and superimposition.

Actuating column through-holes 401, 501 and 601 are arranged correspondingly at middle of the bottom counterweight block 40, top counterweight block 50 and intermediate counterweight block 60.

A lifting actuator 90, includes a lifting actuating column 91 and a locating pin 92, of which the lifting actuating column 91 penetrates vertically the actuating column through-holes 401, 501, 601 of the bottom counterweight block 40, top counterweight block 50 and intermediate counterweight block 60. Pin holes 93 are arranged vertically at interval onto the lifting actuating column 91 correspondingly to the pin threading portion 61 of every intermediate counterweight block 60. The locating pin 92 can be selectively inserted into the pin threading portion 61 of either intermediate counterweight block 60 and pivoted into the corresponding pin hole 93 of the lifting actuating column 91, allowing to adjust the weight for weight training.

Referring to FIG. 3, the guide rod pulling portion 62 of the intermediate counterweight block 60 can be configured with a lateral recessing flange or a vertical through-hole (a round hole). If the guide rod pulling portion 62 is configured with a lateral recessing flange, as disclosed in FIG. 5, and the top counterweight block 50 and lifting actuating column 91 are lifted into a disengagement state, the intermediate counterweight blocks 60 enables removing or adding weights by vertically swinging to change the angle, thus improving substantially the efficiency and convenience of weight adjustment of the intermediate counterweight blocks 60.

Figure 6:
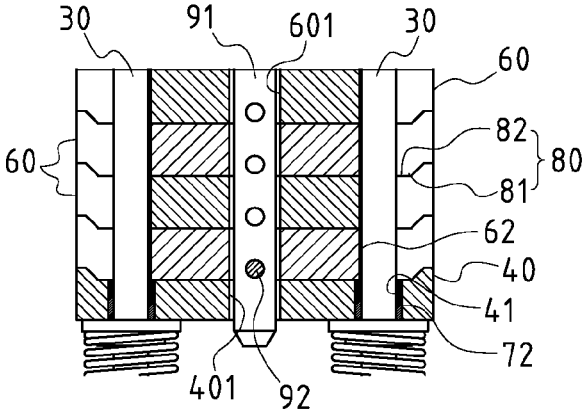
FIG. 6 is another application view of the mating portion of the present invention.
Figure 7:
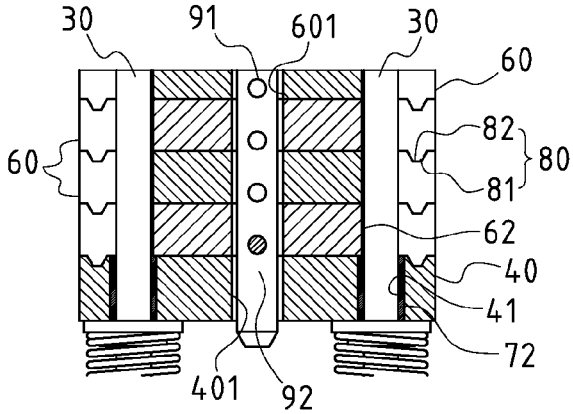
FIG. 7 is another application view of the mating portion of the present invention.
Figure 8:
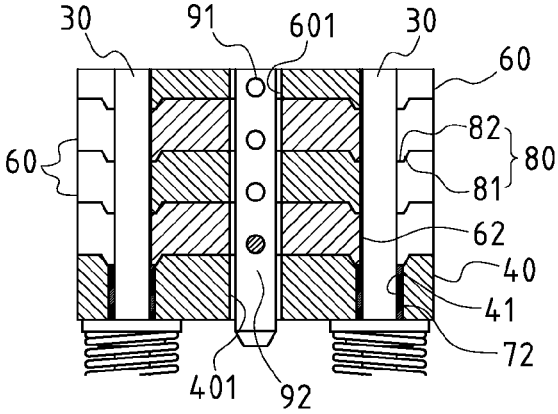
FIG. 8 is yet another application view of the mating portion of the present invention.

Of which, the mating portion 80 can be implemented in several modes. Referring to FIGS. 3 and 4, said mating portion 80 is composed of a bulge 81 and a groove 82 set correspondingly in an area (an intermediate area in this preferred embodiment). Referring to FIG. 6, the mating portion 80 allows the bulge 81 and groove 82 to be displaced vertically. Referring also to FIG. 7, the mating portion 80 is composed of a plurality of bulges 81 and grooves 82 set in a spaced area. Referring to FIG. 8, the difference of said mating portion 80 with that in FIG. 7 lies in that, a plurality of bulges 81 and grooves 82 are distributed around the vertical guide rod 30. Moreover, the bulge 81 can be fabricated from the counterweight block, or prefabricated and then assembled.

Referring to FIGS. 3 and 4, a projecting tube 502 is set at top of the actuating column through-hole 501 onto the top counterweight block 50, and a tapped through-hole 503 is set laterally for screwing a locating button 504. The locating button 504 is provided with a screw rod 505 that can be screwed into the tapped through-hole 503 (only marked in FIG. 4) and abutted onto the lifting actuating column 91 of the lifting actuator 90, such that the top counterweight block 50 and lifting actuating column 91 can be secured more stably.

Referring to FIG. 4, an elastic buffer 42 (e.g. helical spring and rubber spring, etc) is assembled at bottom of the bottom counterweight block 40, enabling buffering and noise reduction of bottom counterweight block 40 when it is lowered to the minimum height.

Based on the above-specified configuration, said counterweight module A is operated as shown in FIG. 4, wherein the intermediate counterweight block 60 and top counterweight block 50 over the inserted locating pin 92 of the lifting actuator 90 (inserted at the height of the lowest intermediate counterweight block 60) will be elevated with the lifting actuating column 91. When the intermediate counterweight block 60 and top counterweight block 50 are elevated, the lifting path can be stabilized through contact sliding between the upper liner ring 71 of the top counterweight block 50 and the vertical guide rod 30. There is no contact between the intermediate counterweight block 60 and vertical guide rod 30 through the design of the guide rod pulling portion 62. But stable non-offset state between the intermediate counterweight blocks 60 or between the intermediate counterweight block 60 and top counterweight block 50 can be realized through the configuration of the mating portion 80.

Referring to FIG. 3, the lifting actuating column 91 of the lifting actuator 90 can be mated with the actuating column through-hole 501 of the top counterweight block 50 through an orienting surface 910, enabling oriented non-offset of the lifting actuating column 91 for more stable elevation. The orienting surface 910 can be implemented by the mating of rectangular and polygonal surfaces, or a tangent surface formed laterally on the round shape.

Figure 5:
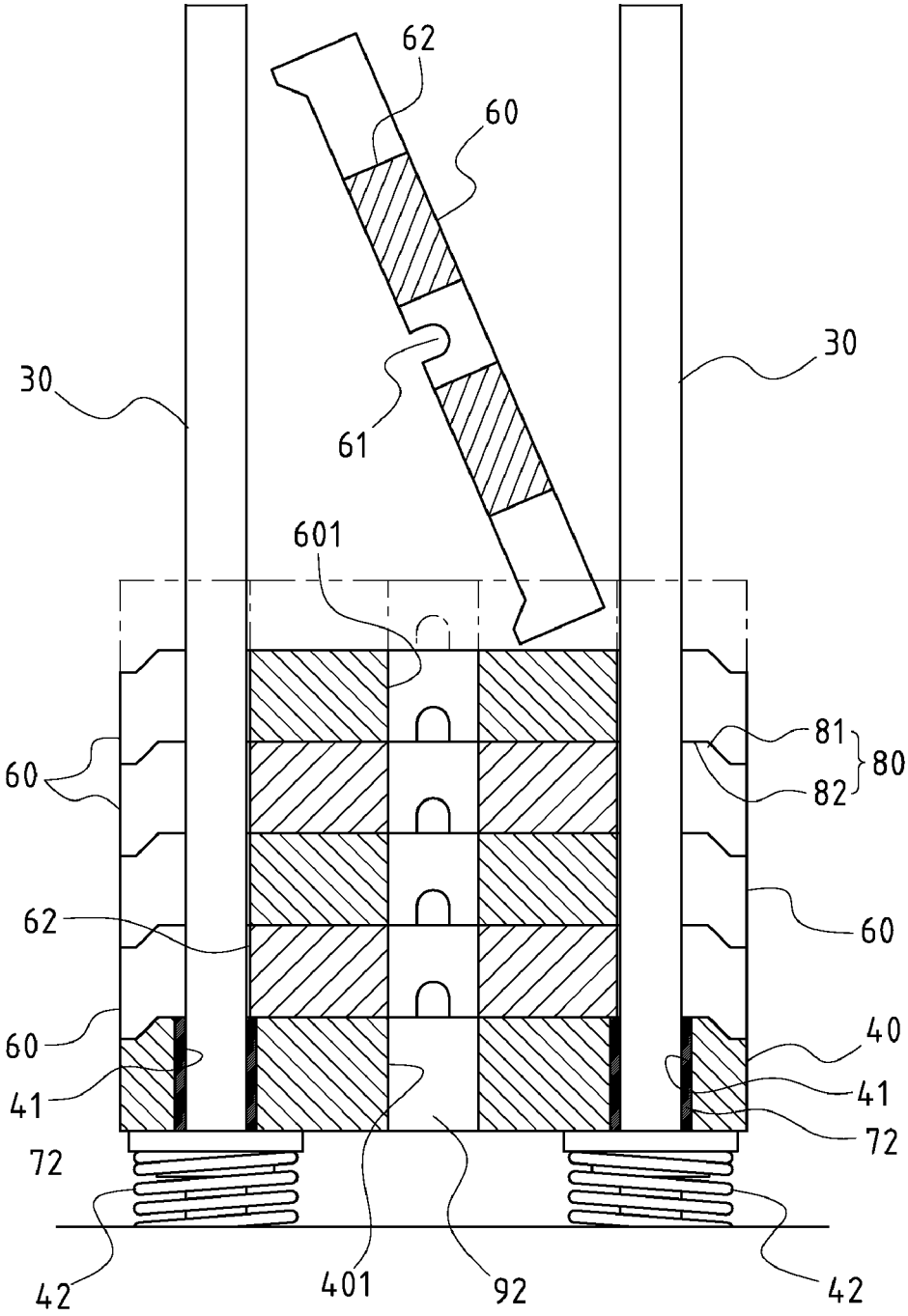
FIG. 5 is a schematic view wherein the intermediate counterweight block of the present invention can be quickly assembled and disassembled.
Figure 9:
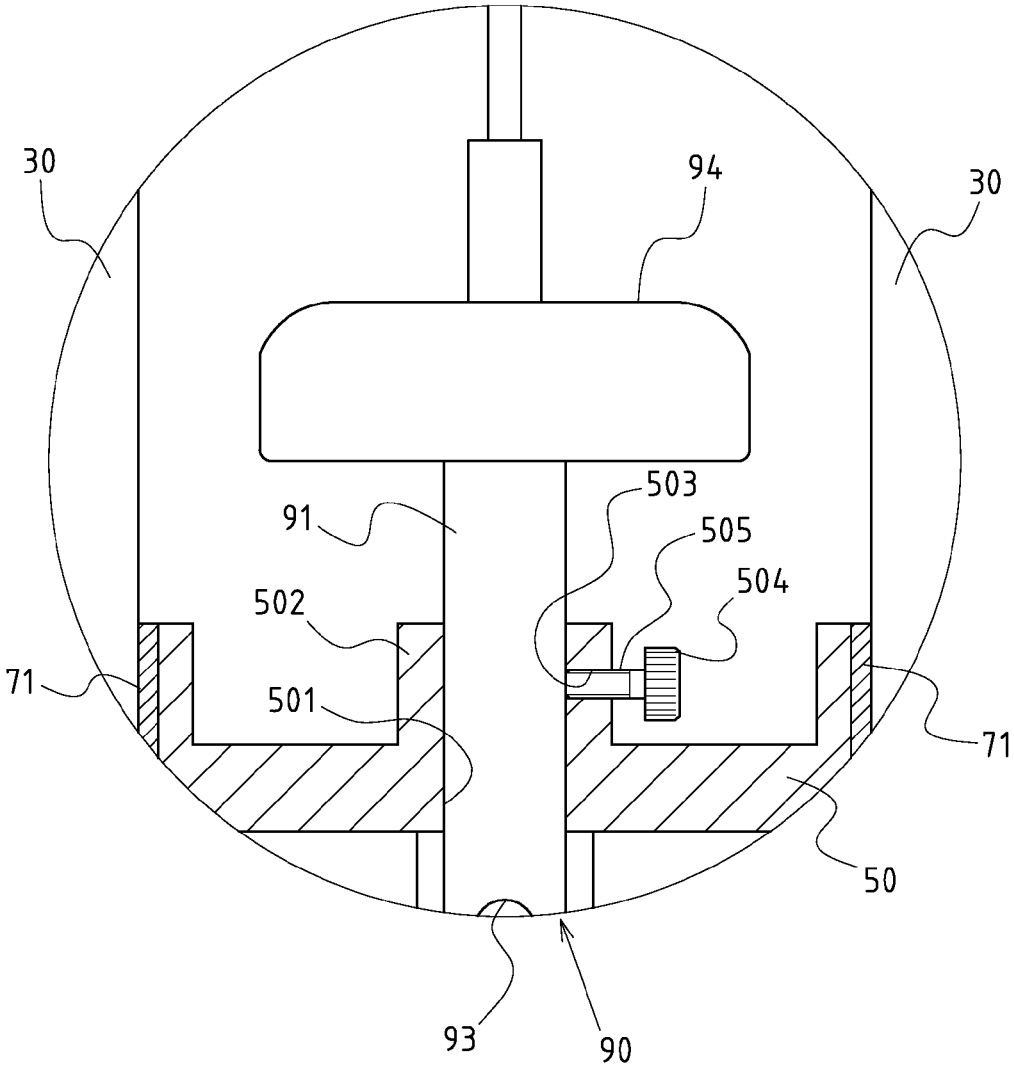
FIG. 9 is an application view wherein a handle is set at top of the lifting actuator of the present invention.

Referring also to FIG. 9, a handle 94 can be additionally set at top of the lifting actuating column 91 of the lifting actuator 90, allowing the user to hold manually the lifting actuating column 91 along with the top counterweight block 50, so as to remove or add the intermediate counterweight blocks 60 as shown in FIG. 5.

I claim:

1. An improved counterweight module structure of a weight trainer, wherein said counterweight module is assembled at a preset load of a weight trainer, and used to provide the counterweight and adjust the weight required for weight training; said counterweight module comprising:

two vertical guide rods, arranged vertically by spaced parallel;

a bottom counterweight block, assembled transversely at lower part of two vertical guide rods; the bottom counterweight block is provided with two spaced sleeving holes for sleeving into two vertical guide rods;

a top counterweight block, assembled transversely onto two vertical guide rods overhead the bottom counterweight block; the top counterweight block is provided with two spaced punch holes for sleeving into two vertical guide rods;

at least an intermediate counterweight block, superimposed transversely between the bottom and top counterweight blocks; and a pin threading portion is set laterally onto every intermediate counterweight block;

a liner ring assembly, only assembled onto the bottom and top counterweight blocks; the liner ring assembly includes upper liner rings set into two punch holes of the top counterweight block, and lower liner rings set into two sleeving holes of the bottom counterweight block; and the annular rings of upper and lower liner rings are mated slidably with two vertical guide rods; and a guide rod pulling portion, set vertically onto every intermediate counterweight block for penetration of the vertical guide rod; there is a spacing between the guide rod pulling portion and vertical guide rod;

a mating portion, arranged between the bottom and intermediate counterweight blocks, or between the intermediate counterweight blocks, or between the intermediate and top counterweight blocks, so that the intermediate counterweight blocks can be limited to avoid displacement;

an actuating column through-hole, arranged correspondingly at middle of the bottom, top and intermediate counterweight blocks;

a lifting actuator, including a lifting actuating column and a locating pin, of which the lifting actuating column penetrates vertically the actuating column through-holes of the bottom, top and intermediate counterweight blocks; and pin holes are arranged vertically at interval onto the lifting actuating column correspondingly to the pin threading portion of every intermediate counterweight block; the locating pin can be selectively inserted into the pin threading portion of either intermediate counterweight block and pivoted into the corresponding pin hole of the lifting actuating column, allowing to adjust the weight for weight training.

2. The improved structure defined in claim 1, wherein the guide rod pulling portion of the intermediate counterweight block has a lateral recessing flange.

3. The improved structure defined in claim 1, wherein the guide rod pulling portion of the intermediate counterweight block has a vertical through-hole.

4. The improved structure defined in claim 1, wherein said mating portion is composed of a bulge and a groove set correspondingly in an area.

5. The improved structure defined in claim 1, wherein the mating portion is composed of a plurality of bulges and grooves set in a spaced area.

6. The improved structure defined in claim 1, wherein a projecting tube is set at top of the actuating column through-hole onto the top counterweight block, and a tapped through-hole is set laterally for screwing a locating button; the locating button is provided with a screw rod that can be screwed into the tapped through-hole and abutted onto the lifting actuating column of the lifting actuator.

7. The improved structure defined in claim 1, wherein an elastic buffer is assembled at bottom of the bottom counterweight block.

8. The improved structure defined in claim 1, wherein the lifting actuating column of the lifting actuator can be mated with the actuating column through-hole of the top counterweight block through an orienting surface, enabling oriented non-offset of the lifting actuating column.

9. The improved structure defined in claim 1, wherein a handle is set at top of the lifting actuating column of the lifting actuator.

* * * * *